US008061979B1

(12) United States Patent
Liang

(10) Patent No.: US 8,061,979 B1
(45) Date of Patent: Nov. 22, 2011

(54) TURBINE BOAS WITH EDGE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1045 days.

(21) Appl. No.: 11/975,666

(22) Filed: Oct. 19, 2007

(51) Int. Cl.
*F01D 11/08* (2006.01)

(52) U.S. Cl. ..... 415/173.1

(58) Field of Classification Search ..... 415/173.1
See application file for complete search history.

(56) References Cited

U.S. PATENT DOCUMENTS

| | | | | |
|---|---|---|---|---|
| 5,375,973 | A | 12/1994 | Sloop et al. | |
| 5,486,090 | A | 1/1996 | Thompson et al. | |
| 5,538,393 | A | 7/1996 | Thompson et al. | |
| 5,584,651 | A | 12/1996 | Pietraszkiewicz et al. | |
| 6,354,795 | B1 | 3/2002 | White et al. | |
| 6,508,623 | B1 | 1/2003 | Shiozaki et al. | |
| 6,602,048 | B2 | 8/2003 | Fujikawa et al. | |
| 6,659,716 | B1 | 12/2003 | Laurello et al. | |
| 6,676,370 | B2 | 1/2004 | Tiemann | |
| 6,899,518 | B2 | 5/2005 | Lucas et al. | |
| 6,905,302 | B2 * | 6/2005 | Lee et al. | 415/115 |
| 7,137,776 | B2 * | 11/2006 | Draper et al. | 415/115 |
| 7,246,992 | B2 * | 7/2007 | Lee | 415/115 |
| 7,246,993 | B2 | 7/2007 | Bolms et al. | |
| 7,306,424 | B2 * | 12/2007 | Romanov et al. | 415/115 |
| 7,517,189 | B2 * | 4/2009 | Camus | 415/173.1 |
| 7,621,719 | B2 * | 11/2009 | Lutjen et al. | 415/173.1 |

* cited by examiner

*Primary Examiner* — Ninh H Nguyen
(74) *Attorney, Agent, or Firm* — John Ryznic

(57) ABSTRACT

A cooling hole having an inlet passage forming an inward spiral flow path and an outlet passage forming an outward spiral flow path in which the two paths are counter flowing in order to improve the heat transfer coefficient. The spiral cooling hole is used in a blade outer air seal (BOAS) for a turbine in which the edges of the shroud segments include a counter flowing micro serpentine flow cooling circuit with thin diffusion discharge cooling slots for the BOAS edges. The total BOAS cooling air is impingement from the BOAS cooling air manifold and metered through the impingement cooling holes to produce impingement cooling onto the backside of the BOAS. The spent cooling air is then channels into the multiple micro serpentine cooling flow circuits located around the four edges of the shroud segments. This cooling air then flows in a serpentine path through the horizontal serpentine flow channels and then discharged through the thin diffusion cooling slots as peripheral purge air for the mate faces as well as the spacing around the BOAS or shroud segments. Trip strips are used in the serpentine flow channels for the augmentation of internal heat transfer cooling capability. The micro serpentine flow cooling air circuits spaced around the four edges of the shroud segments are formed into the shroud segments during the casting process of the shroud segments.

21 Claims, 5 Drawing Sheets

TURBINE BOAS WITH EDGE COOLING

BACKGROUND OF THE INVENTION

1. Field of the Invention

The present invention relates generally to a gas turbine engine, and more specifically to a blade outer air seal with cooling of the edges.

2. Description of the Related Art including information disclosed under 37 CFR 1.97 and 1.98

In a gas turbine engine, the turbine includes at least on stage of rotor blades that include blade tips that form a seal with an outer shroud of the engine. A gap or space is formed between the blade tip and the inner surface of the shroud in which hot gas leakage can flow. The outer shroud is formed of a plurality of shroud segments that together form a full 360 degree annular configuration around the rotating blades. Excess hot gas leakage flowing through this gap will decrease the turbine efficiency and lead to hot spots on the blade tip and shroud segment in which oxidation can develop and therefore shorten the life of the parts.

In the prior art of gas turbine engines, a blade outer air seal (BOAS) edge cooling is accomplished by drilling holes into the impingement cavity located at the middle of the BOAS from both of the leading edge and trailing edge of the BOAS as well as from the BOAS mate faces. FIG. 1 shows this prior art air cooled BOAS with the blade ring carrier 11, a cooling air supply hole 12, a forward isolation ring 15 and a rearward isolation ring 13, an upstream vane 16 and a downstream vane 14, a cooling air manifold or cavity 17, the shroud segment 16, an impingement plate 19 with a stiffener rib 20 and a plurality of impingement holes 21, a front impingement compartment 25 and a rear impingement compartment 26, and a TBC or thermal barrier coating 23 on the inner surface of the shroud segment 18 that forms the gap with a tip of the rotor blade 22. Cooling air supplied from the compressor flows through the cooling hole 12 and into the cavity 17, and then through the impingement holes 21 to produce impingement cooling on the backside of the shroud segment 18. The spent cooling air in the impingement compartments 25 and 26 then flows through the drilled cooling holes formed in the four edges of the shroud segment as shown in FIG. 2.

BRIEF SUMMARY OF THE INVENTION

It is an object of the present invention to provide for an improved cooling air hole.

It is another object of the present invention to provide for a turbine BOAS in which the drilled holes are eliminated.

It is another object of the present invention to provide for a turbine BOAS with an improved cooling flow control over the cited prior art references.

It is another object of the present invention to provide for a turbine BOAS with a higher cooling effectiveness than in the cited prior art references.

It is another object of the present invention to provide for a turbine BOAS with a higher edge cooling coverage than in the cited prior art references.

A blade outer air seal (BOAS) for a turbine in which the edges of the shroud segments include a counter flowing micro serpentine flow cooling circuit with thin diffusion discharge cooling slots for the BOAS edges. The total BOAS cooling air is impingement from the BOAS cooling air manifold and metered through the impingement cooling holes to produce impingement cooling onto the backside of the BOAS. The spent cooling air is then channels into the multiple micro serpentine cooling flow circuits located around the four edges of the shroud segments. This cooling air then flows in a serpentine path through the horizontal serpentine flow channels and then discharged through the thin diffusion cooling slots as peripheral purge air for the mate faces as well as the spacing around the BOAS or shroud segments. Trip strips are used in the serpentine flow channels for the augmentation of internal heat transfer cooling capability. The micro serpentine flow cooling air circuits spaced around the four edges of the shroud segments are formed into the shroud segments during the casting process of the shroud segments. Thus, no drilling of the cooling holes are required as in the cited prior art.

DETAILED DESCRIPTION OF THE INVENTION

Figure 1:
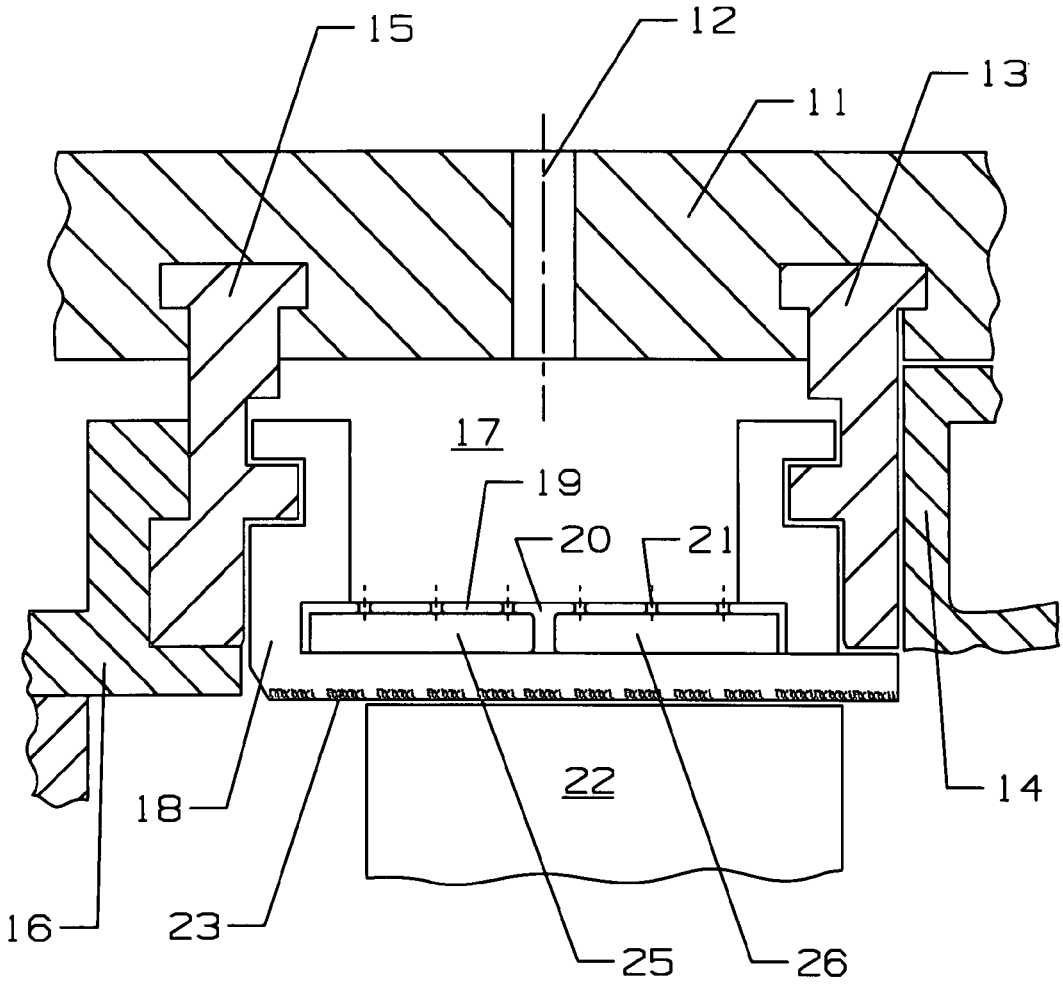
Fig 1 Prior Art
FIG. 1 shows a cross section side view of a prior art BOAS with the shroud segment and the impingement cooling holes.
Figure 2:
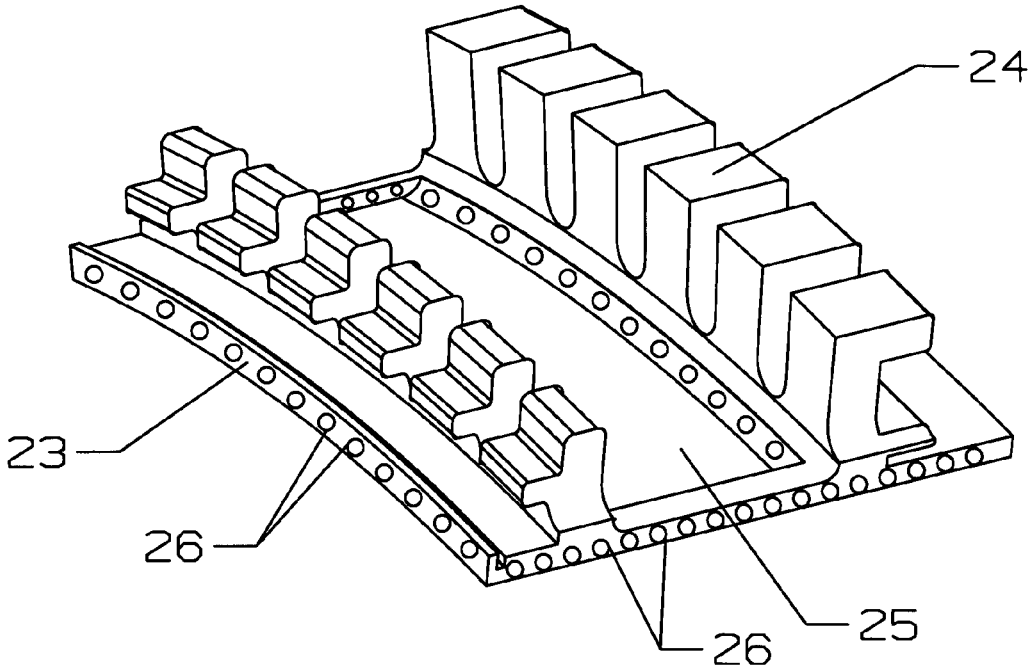
Fig 2 Prior Art
FIG. 2 shows a schematic view of the prior art shroud segment with the drilled cooling holes present on the four edges of the segment.

The present invention is a BOAS (blade outer air seal) for a gas turbine engine in which a plurality of shroud segments form the BOAS with tips of the rotor blades. The BOAS of the present invention includes a plurality of counter flowing micro serpentine flow cooling circuits spaced around the four edges of the shroud segments. The BOAS of the present invention can take the form of the prior art BOAS, as in FIGS. 1 and 2, but with the drilled holes replaced by the counter flowing micro serpentine flow cooling circuits.

Figure 3:
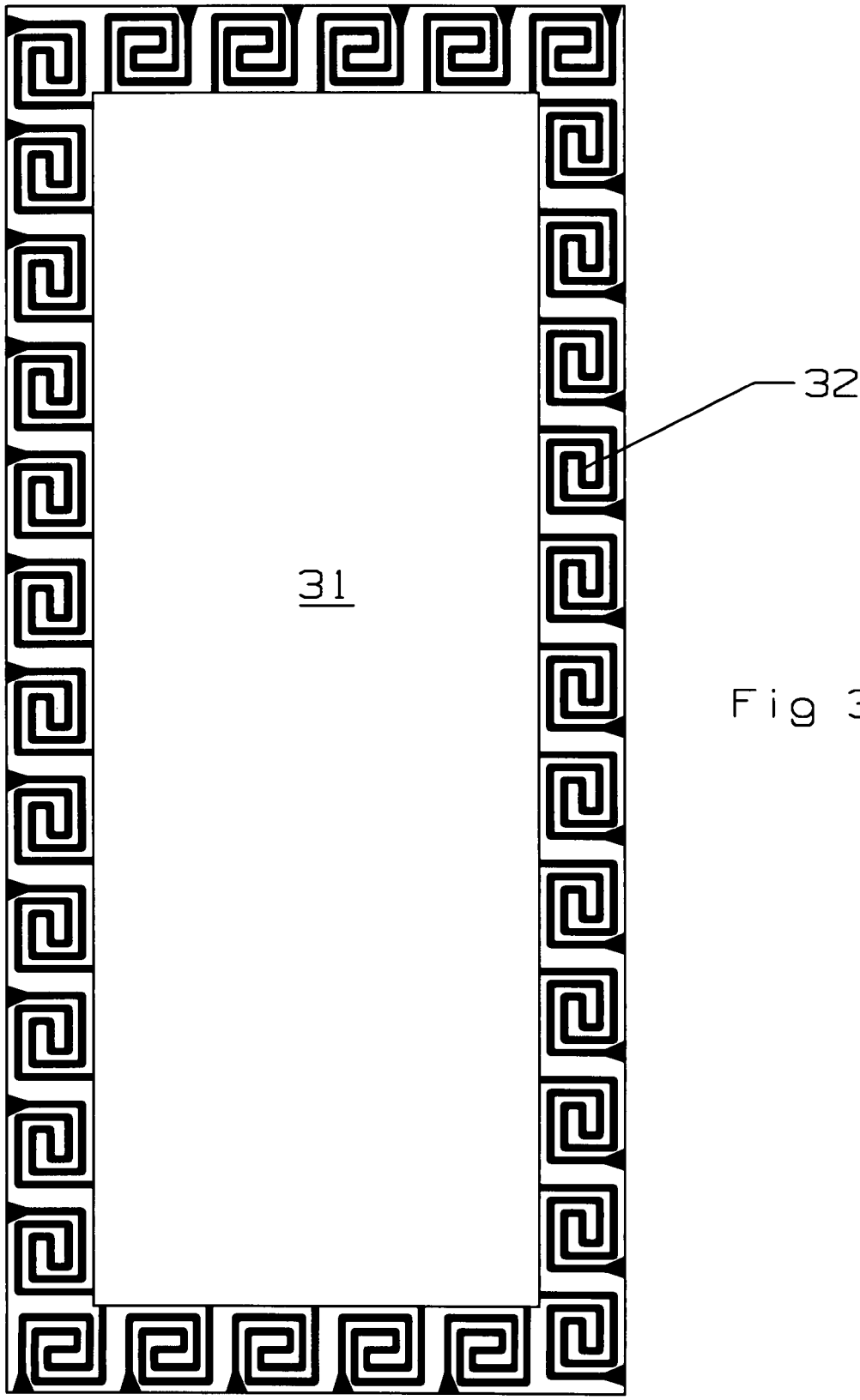
FIG. 3 shows a top view through a cross section of the shroud segment of the present invention with the micro serpentine flow cooling circuits spaced around the four edges of the shroud segment.
Figure 4:
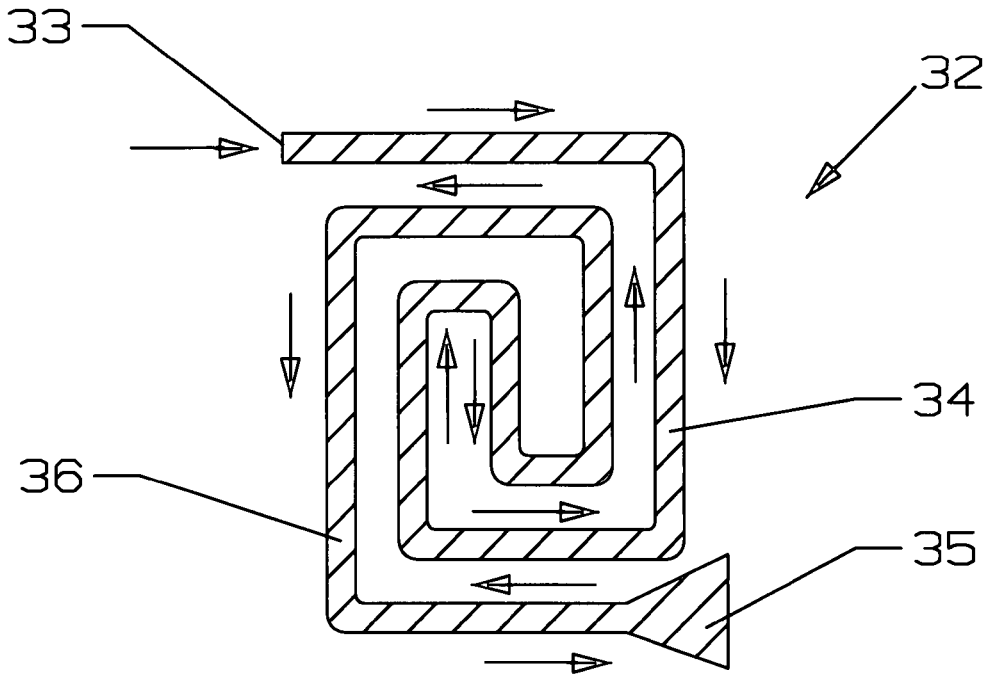
FIG. 4 shows a detailed view of one of the micro serpentine flow cooling circuits of the present invention with trip strips.

FIG. 3 shows a cross section top view of one of the shroud segments that form the BOAS, and includes an impingement area 31 within the four edges of the shroud segment. A plurality of the counter flowing micro serpentine flow cooling circuits 32 are spaced around the four edges as seen in FIG. 3. Each of the micro circuits 32 include an inlet that opens into the impingement area 31 so that the spent cooling air can flow into the micro circuits 32. The micro circuits also include an outlet end with a diffuser 35 to diffuse the cooling air flow at the exit end as seen in FIG. 4. Each of the micro circuits 32 has a counter flowing and serpentine flowing path from inlet 33 to exit 35 as seen in FIG. 4 in order that the inlet and the outlet will be on the outside edge of the individual circuit. To improve the heat transfer coefficient, trip strips 36 are positioned along the walls of the micro circuit passages 34. The micro serpentine circuit 32 of FIG. 4 has eleven sides from the inlet 33 to the outlet 35. As seen in FIG. 4, the inlet passage includes 5 legs that spiral inward and flow in a clockwise direction. The outlet passage includes 5 legs that spiral outward and flow in a counter clockwise direction. A middle leg joins the clockwise passage and the counter clockwise passage in the middle and is considered to be both a clockwise and a counter clockwise flowing leg. The counter flowing passages of the micro serpentine circuit 32 allows for the inlet and the outlet of the cooling circuit to be located on the outer edges of the circuit. The legs of the micro serpentine circuit 32 are shown as being substantially straight and parallel to adjacent legs in order to provide the best heat transfer coefficient. However, the legs can be curved or rounded or any other shape that would fit within the desired area and would provide the counter flowing passages. Also, the micro serpentine circuit is shown with the inlet passage to be clockwise flowing and the outlet passage to be counter clockwise flowing. However, the image shown in FIG. 4 can be reversed in which the inlet passage would be counter clockwise flowing and the outlet passage to be clockwise flowing. The same reversal can be applied to the other embodiments described below.

Figure 5:
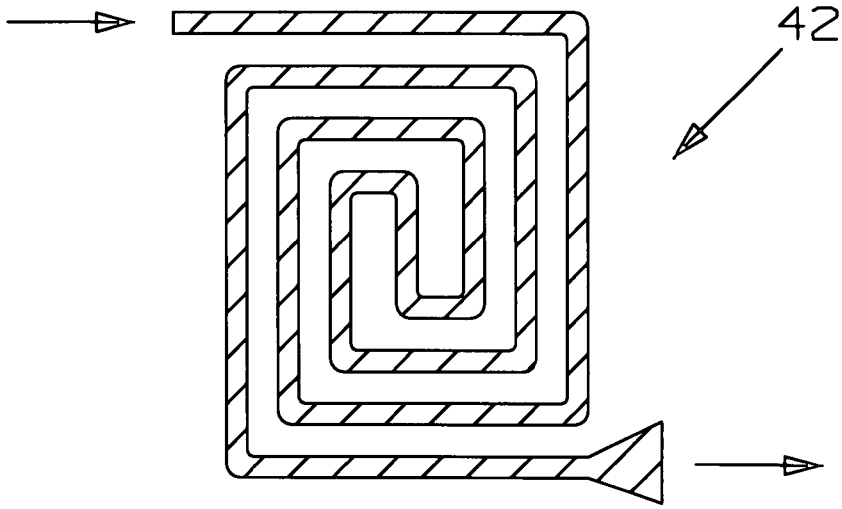
FIG. 5 shows a detailed view of a second embodiment of the micro serpentine flow cooling circuits of the present invention with more convective area and more effective cooling than the first embodiment.

FIG. 5 shows a second embodiment of the counter flowing micro serpentine flow cooling circuits 42 in which the spiral shaped circuit has an additional spiral than in the first embodiment micro circuit 32 to form a total of fifteen spiral sides instead of the eleven of the first embodiment. This fifteen sided micro serpentine circuit 42 provides for more convective area and more effective cooling than the first embodiment circuit 32. Trip strips can also be used in the second embodiment micro circuit 42 to enhance the heat transfer coefficient.

Figure 6:
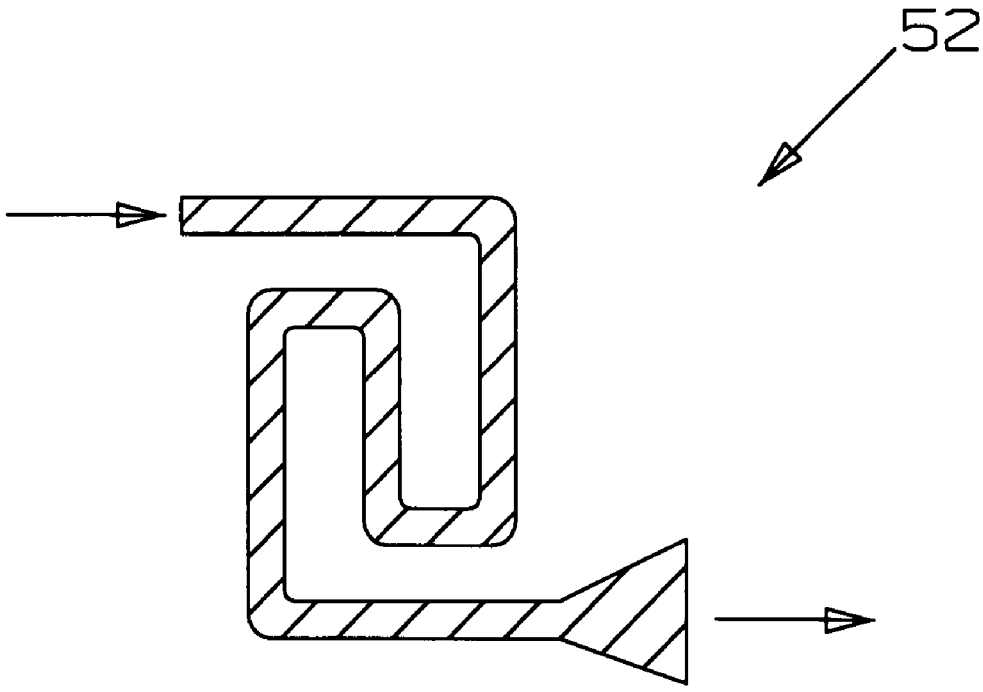
FIG. 6 shows a detailed view of a third embodiment of the micro serpentine flow cooling circuits of the present invention.

FIG. 6 shows a third embodiment of the micro serpentine flow circuit in which only seven legs are used in the circuit. The inlet forms a clockwise flowing passage with the first three legs and the outlet forms a counter flowing passage with the last three legs. The middle leg that connects the clockwise and the counter-clockwise passages can be considered as both clockwise flowing and counter-clockwise flowing. This seven leg circuit would provide less heat transfer from the hot metal to the cooling air than would the other embodiment with more legs. However, the seven leg circuit could be used in smaller areas in which the other embodiments could not fit without decreasing the diameter of the cooling holes or legs.

The micro serpentine flow circuits 32 and 42 are positioned within the edges of the shroud segment in a plane that is substantially parallel with the outer surface of the shroud segment that forms the hot gas flow path through the turbine. Placing the micro serpentine circuits close to the hot wall surface of the shroud segment will provide the highest level of cooling. The micro serpentine circuits flow clockwise on the inward flowing loop and flows counter clockwise on an outward flowing loop which flows from the inside to the outside of the circuit as seen in FIGS. 4 and 5.

In both embodiments above, the micro serpentine circuits 32 and 42 are cast into the shroud segment in order to eliminate the need for drilling the holes. The advantages of the blade outer air seal edge cooling of the present invention over the cited prior art drilled edge cooling are listed below. Firstly, the elimination of the BOAS edge cooling drilling holes. Since the entire cooling design can be cast into the BOAS, drilling cooling holes around the BOAS edges is eliminated. This will reduce the BOAS manufacturing coast and improve the BOAS life cycle cost. Secondly, enhanced coolant flow control is achieved. Individual serpentine flow modules allow for tailoring of edge cooling flow to the various supply and discharge pressures around the BOAS edges. Thirdly, a high cooling effectiveness is achieved. A higher cooling effectiveness level is produced by the peripheral micro serpentine flow cooling channels than by the prior art drilled cooling holes. Also, the micro serpentine flow module achieves a thermally balanced serpentine flow design since each individual cooling flow channel in the module is in a counter flowing direction relative to each other. Fourthly, a higher edge cooling coverage is achieved. Thin diffusion exit cooling slots yields higher edge cooling coverage and minimizes hole plugging for the BOAS edge perimeter and therefore achieves a better BOAS edge cooling and a lower edge section metal temperature than the drilled cooling holes of the prior art.

I claim the following:

1. A shroud segment for use in a gas turbine engine, the shroud segment forming a BOAS with a stage of rotating blades, the shroud segment comprising:

an impingement surface area on an opposite side from the hot gas flow surface;

an edge of the shroud segment having a plurality of micro serpentine flow circuits spaced along the edge;

each micro serpentine flow circuit including an inlet in fluid communication with the impingement surface area to allow for spent impingement air to flow into the micro serpentine flow circuit and an outlet end opening onto the edge of the shroud segment; and, the impingement surface is inside of the plurality of micro serpentine flow circuits.

2. The shroud segment of claim 1, and further comprising:

the micro serpentine flow circuits are positioned along all four sides of the shroud segment.

3. The shroud segment of claim 1, and further comprising:

the outlet end of each micro serpentine circuit is connected to a diffuser that opens onto the outer surface of the edge.

4. The shroud segment of claim 1, and further comprising:

each micro serpentine circuit includes an inward flowing loop and a counter flowing outward flowing loop.

5. The shroud segment of claim 1, and further comprising:

each micro serpentine circuit consists of eleven legs from the inlet end to the outlet end.

6. The shroud segment of claim 1, and further comprising:

each micro serpentine circuit consists of fifteen legs from the inlet end to the outlet end.

7. The shroud segment of claim 1, and further comprising:

the micro serpentine circuits each include legs that are substantially straight with elbows connecting the adjacent legs.

8. The shroud segment of claim 7, and further comprising:

spacing between the legs is substantially the same distance.

9. The shroud segment of claim 8, and further comprising:

spacing between adjacent micro serpentine circuits is substantially the same distance between the spacing between legs in the micro serpentine circuit.

10. The shroud segment of claim 7, and further comprising:

each micro serpentine circuit is substantially square in cross sectional shape from a top view.

11. A process for cooling a BOAS in a gas turbine engine comprising the steps of:

supplying pressurized cooling air to a BOAS cooling air manifold;

impinging cooling air onto the backside of the BOAS;

passing the spent cooling air through a plurality of serpentine flow cooling circuits spaced around the edges of the shroud segment; and, discharging the spent cooling air from the serpentine flow cooling circuits onto the edge surfaces of the shroud segment.

12. The process for cooling a BOAS of claim 11, and further comprising the step of:

diffusing the spent cooling air prior to discharging the spent cooling air onto the edges of the shroud segment.

13. The process for cooling a BOAS of claim 11, and further comprising the step of:

passing the spent cooling air through the plurality of serpentine flow cooling circuits in an inward flowing spiral loop followed by an outward flowing spiral loop prior to discharging onto the edges.

14. The process for cooling a BOAS of claim 11, and further comprising the step of:

passing the spent cooling air through the plurality of serpentine flow cooling circuits substantially parallel to the hot gas flow surface of the shroud segment.

15. The process for cooling a BOAS of claim 11, and further comprising the step of:

promoting a turbulent flow in the spent cooling air passing through the plurality of serpentine flow cooling circuits.

16. A cooling hole to provide convection cooling to a hot surface, the cooling hole comprising:

an inlet passage forming an inward spiral and flowing in a clockwise or a counter clockwise direction; and, an outlet passage forming an outward spiral and flowing in a counter direction to the inlet passage.

17. The cooling hole of claim 16, and further comprising: a diffuser on the end of the outlet passage.

18. The cooling hole of claim 16, and further comprising: the inlet passage and the outlet passage are both formed of substantially straight legs that are parallel to each other.

19. The cooling hole of claim 18, and further comprising: a spacing between adjacent legs of the two passages are substantially the same.

20. The cooling hole of claim 16, and further comprising: the inlet passage and the outlet passage have the same number of legs.

21. The cooling hole of claim 16, and further comprising: the inlet passage and the outlet passage each include at least five legs each.

* * * * *